US006591894B2

(12) United States Patent
Guha et al.

(10) Patent No.: US 6,591,894 B2
(45) **Date of Patent: *Jul. 15, 2003**

(54) SHOT BLOCKS FOR USE IN DIE CASTING

(75) Inventors: Amitava Guha, Richmond Heights, OH (US); William D. Nielsen, Jr., Avon Lake, OH (US)

(73) Assignee: Brush Wellman, Inc., Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/882,904

(22) Filed: Jun. 15, 2001

(65) Prior Publication Data

US 2003/0051854 A1 Mar. 20, 2003

(51) Int. Cl.[7] ..... B22D 17/08
(52) U.S. Cl. ..... 164/312; 164/113
(58) Field of Search ..... 164/113, 312

(56) References Cited

U.S. PATENT DOCUMENTS 3,532,561 A * 10/1970 Barto et al. ..... 148/320
4,345,637 A * 8/1982 Flemings et al. ..... 164/113
6,001,196 A 12/1999 Harkness et al.

OTHER PUBLICATIONS

"Die Casting," *Metals Handbook*, ©1985, American Society for Metals, pp. 23*32 to 23*41.

Harkness et al., "Beryllium–Copper and Other Beryllium–Containing Alloys," *Metals Handbook*, vol. 2, 10$^{th}$ Ed., ©1993 ASM Int'l.

William Nielsen, Jr. et al., "Unwrought Continuous Cast Copper–Nickel–Tin Spinodal Alloy," U.S. Patent Appln. No. 08/552,582, filed Nov. 3, 1995 (New Zealand Patent No. 309290).

* cited by examiner

*Primary Examiner*—Kuang Y. Lin
(74) *Attorney, Agent, or Firm*—Calfee, Halter & Griswold, LLP

(57) ABSTRACT

A shot block for use in a die casting machine for die casting molten and semi-molten metal parts is formed from a metal or metal alloy having a thermal conductivity of at least about 25 Btu/ft.hr.° F., a Rockwell C hardness of at least about 25 and a 0.2% Yield Strength of at least about 90 ksi.

19 Claims, No Drawings

SHOT BLOCKS FOR USE IN DIE CASTING

BACKGROUND OF THE INVENTION

1. Field

The present invention relates to die casting and in particular to new shot blocks for use in die casting and other similar casting operations.

2. Background

Die casting, which is also known as "pressure die casting" and "squeeze casting," is a well known casting process in which molten metal is forced under high pressure into permanent steel dies. See *Metals Handbook,* ©1985 American Society for Metals, pages 23*32 to 23*41, the disclosure of which is incorporated herein by reference. "Thixoforging" or "thixoforming" are similar processes in which the metal being cast is in a semi-solid state (i.e. a solid/liquid mixture) rather than in purely molten form.

In conventional die casting and thixoforming operations, a piston or like device forces the metal being cast into the die through one or more passageways or "runners" which are connected to a manifold for receiving the pressurized metal. Thus, a conventional die casting machine typically includes a die composed of a cover die half and an ejector die half. The cover die half and the ejector die half mate with one another along a separation surface and together define multiple die cavities. The cover die half is stationary, while the ejector die half is movable so that when a molten charge solidifies, the ejector die half can be moved apart from the cover die half so that the solidified charge in each mold cavity can be removed.

Molten or semi-molten metal to be cast is charged into the die cavities by a charging assembly which includes a pressure cylinder for receiving molten metal from an inlet, a piston movable in the pressure cylinder for forcing the molten metal into the die cavities, and a shot block made from conventional tool steel mounted in or on the cover die half of the die. The shot block defines a manifold or reservoir for receiving molten metal from the pressure cylinder and supplying this molten metal to the die cavities via passageways or "runners" defined in the separation surface between the cover die half and the ejector die half of the die. Flow passageways are normally provided in the shot block for cooling the metal in the reservoir by indirect heat exchange using water, hot oil or other liquid as the cooling medium.

Because molten metal shrinks as it solidifies, it is important that additional amounts of molten metal be continuously supplied at high pressure to the mold cavities until enough metal in these cavities has solidified. To this end, the reservoir in the shot block as well as the runners are normally designed to be large enough so that at least some metal in these locations is still molten when the necessary degree of solidification has been reached in the mold cavities. In actual practice, this often means that the metal in the reservoir (typically referred to as a "biscuit") will still be molten, or at least partially molten, when the metal in the mold cavities has completely solidified.

Once the metal in the mold cavities has solidified, the mold halves are separated from one another and the solidified castings in these cavities removed for further processing. However, for safety reasons, this cannot be done until the metal in the reservoir of the shot block has also solidified substantially. In this connection, it has been found that the metal in the shot block reservoir, since it is present under high pressure, can actually explode if the mold halves are opened too soon. Therefore, care must be taken to insure that the metal in the shot block reservoir solidifies sufficiently before the mold halves are separated from one another.

In modern industrial practice, it is always desirable to increase efficiency. To this end, commercial die casting machines such as described above are typically operated with as little cycle time as possible. In other words, the time between successive casting cycles is minimized to the greatest extent possible. Unfortunately, the time it takes molten metal in the shot block reservoir to solidify sufficiently represents the constraining factor in achieving shorter cycle times in 25 to 50% of commercial die casting operations.

Accordingly, there is a need for new technology which enables shorter cycle times to be achieved yet still allows the metal biscuit in the reservoir to solidify sufficiently before the mold halves are separated.

SUMMARY OF THE INVENTION

In accordance with the present invention, it has been found that the cycle times of die casting and like machines can be considerably shortened, while still allowing the metal biscuits in the shot block reservoirs of such machines to solidify sufficiently, by forming the shot blocks used in such machines from metal or metal alloys having a thermal conductivity of at least about 25 Btu/ft.hr.° F., a Rockwell C hardness of at least about 25 and a 0.2% Yield Strength of at least about 90 ksi.

Thus, the present invention provides a new shot block for use in die casting molten and semi-molten metal parts wherein the shot block is formed from a metal or metal alloy having a thermal conductivity of at least about 25 Btu/ft.hr.° F., a Rockwell C hardness of at least about 25 and a 0.2% Yield Strength of at least about 90 ksi.

In addition, the present invention also provides a new die casting machine including a die, a pressure cylinder for supplying molten or semi-molten metal to the die under pressure and a shot block defining a reservoir for transferring the molten or semi-molten metal received from the pressure cylinder to the die, characterized in that the shot block is made form from a metal or metal alloy having a thermal conductivity of at least about 25 Btu/ft.hr.° F., a Rockwell C hardness of at least about 25 and a 0.2% Yield Strength of at least about 90 ksi.

DETAILED DESCRIPTION

In accordance with the present invention, conventional die casting machines and other like pieces of equipment for charging molten or semi-molten metals into dies under high pressure are equipped with shot blocks made from metals or metal alloys having a thermal conductivity of 25 Btu/ft.hr.° F., a Rockwell C hardness of at least 25 and a 0.2% Yield Strength of at least 90 ksi. Therefore, the shot block in the apparatus described above, rather than being made from H13 tool steel or other conventional alloy, is made from an alloy having this combination of properties.

Properties of Metals Used in Forming Inventive Shot Block

An important feature of the metals or alloys used in making shot block 30 in accordance with the present invention is that they have thermal conductivities of at least about 25 Btu/ft.hr.° F., preferably at least about 37 Btu/ft.hr.° F. Metals or alloys having thermal conductivities of at least about 60 Btu/ft.hr.° F. are more interesting, while metals or alloys having thermal conductivities of at least about 145 Btu/ft.hr.° F. are of special interest. H13 tool steel, which is the material from which shot blocks are typically made, has a thermal conductivity of about 15 Btu/ft.hr.° F., which is about half that of the metals forming the inventive shot blocks or less. Surprisingly, it has been found that this difference allows the inventive shot blocks to provide a more rapid cooling of the metal biscuit in the shot block reservoir, and hence a faster solidification of this metal biscuit, even though the same type and amount of cooling liquid is used to cool the shot block during the casting operation. This, in turn, allows cycle times to be significantly shortened while still maintaining all other structural and operating features of the casting operation the same.

A second important features of the metals and alloys used to form the inventive shot block is that they have a Rockwell C hardness of at least about 25. A common problem associated with conventional shot blocks is that they show significant amounts of surface cracking—i.e., small cracks with an average maximum crack length of about 0.080 inch and a total crack area of about 0.8 $in^2$. In accordance with the present invention, it has been found that this problem is substantially eliminated by making the inventive shot blocks from metals and alloys which have a Rockwell C hardness of at least about 25 in addition to the thermal conductivities mentioned above. In particular, it has been found that the shot blocks made in accordance with the present invention show about 1/10 (10%) of the surface cracking of conventional shot block made from H13 tool steel, when operated under essentially the same conditions. Metals and alloys having Rockwell C hardnesses of at least about 30, and especially at least about 35, are particularly interesting.

The metals and alloys used to form the inventive shot block should also have a strength comparable to that of the H13 tool steel used to make conventional shot blocks. Accordingly, these metals and alloys should have a 0.2% Yield Strength of at least about 90 ksi at room temperature. Metals and alloys with 0.2% Yield Strengths of at least about 100, and even 120 ksi are especially interesting.

Another desirable feature of the metals and alloys used to form the inventive shot block is that they exhibit good resistance to softening at elevated temperature. Some metals lose strength and/or hardness after repeated and/or prolonged exposure to elevated temperatures. Even H13 tool steel loses hardness and strength properties after repeated die casting cycles, at least with respect to processing most materials. The metals and alloys used to form the inventive shot block preferably exhibit a resistance to softening at elevated temperature which is at least as good as that of H13 tool steel and, more desirably even better than that of H13 tool steel.

Still another important feature of the metals and alloys used to form the inventive shot block is that they exhibit good machinability, as this makes fabrication considerably less expensive. Metals and alloys at least 50% more machinable than H13 tool steel as determined by ASTM E618 are desirable, while at least twice as machinable as determined by this test method are especially desirable.

Still another desirable feature in the metals and alloys used to form the inventive shot block is that they exhibit appropriate thermal expansion properties. Since the inventive shot blocks will be mounted in or on other steel parts, it is desirable that the metals and alloys forming the inventive shot blocks have a coefficient of thermal expansion which is similar to that of the steel parts on which the shot blocks will be mounted. Accordingly, the metals and alloys used to form the inventive shot block should preferably have a coefficient of thermal expansion which does not differ from the coefficient of expansion of H13 tool steel by more than 50% in either direction. In other words, it should not be more than 50% greater than the coefficient of expansion of H13 tool steel or less than 50% of the coefficient of expansion of H13 tool steel.

Still another desirable feature in the metals and alloys used to form the inventive shot block is limited porosity. In particular, these metals and alloys should have a porosity corresponding to a density of at least 90% of theoretical in order to provide the necessary heat transferability, strength and structural integrity. Porosities of at least 95 and at least 98% of theoretical density are desirable. In many instances, the inventive shot blocks will be made by conventional casting of molten alloys. In these cases, the shot blocks produced will normally have porosities of 100% of theoretical, as they will be completely solid. In other instances, however, the inventive shot blocks can be produced by powder metallurgy and other techniques which can introduce significant porosity into the products obtained. Accordingly, it is desirable in accordance with the present invention that shot blocks made by such techniques be processed to have porosities of at least about 90% of theoretical and preferably even more.

Still another desirable feature of the metals and alloys used to form the inventive shot block is that they be unreactive to the molten metal being cast. Welding or soldering of a metal being cast to a metal die used in the molding operation can often be a problem. Such problems are normally resolved by changing the chemical composition of the metal being cast, the metal forming the die, or both. Alternatively, such problems can be resolved by modifying the surface of the shot block to minimize unwanted reactions with the metal to be cast, such as by coating or other technique. Obviously, the inventive shot block should also be formed from a metal or alloy which does not undergo unwanted reactions with the metal to be cast, or which can be surface modified so as not to undergo unwanted reactions with the metal to be cast, to any significant degree. This can easily be determined by routine experimentation.

The metals and alloys used to form the inventive shot block are also desirably resistant to corrosion from the water, hot oil or other fluid used for cooling purposes. Stress corrosion cracking can occur in the cooling passageway surfaces if these surfaces begin to corrode, and so it is desirable that these metals and alloys also resist such corrosion. Similarly, it is also desirable that these metals and alloys do not promote, but instead preferably retard, any biological growth that may occur in the cooling passages during exposure to these fluids.

Precipitation Hardenable Alloys

A wide variety of different metals and alloys satisfy the above criteria and hence are useful in making the inventive shot blocks. Examples include the precipitation hardenable alloys containing at least 25 wt. % of a base metal selected from aluminum, nickel, iron, copper, silver, gold, magnesium and titanium. Particular examples are aluminum-beryllium, copper-niobium, nickel-beryllium alloys and the like. These alloys are described, for example, in the following patent applications and patents, the disclosures of which are incorporated herein by reference: Ser. No. 09/387,894, filed Sep. 1, 1999 (20721/04404), Serial No. PCT/US 00/24278, filed Sep. 1, 2000 (20721/04426) and Ser. No. 09/797,465, filed Mar. 1, 2001 (20721/04425).

A particularly useful alloy in connection with the present invention is composed of a base metal comprising copper, nickel or aluminum plus up to about 75 wt. % beryllium. Preferred alloys of this type include at least about 90 wt. % base metal and up to about 10 wt % Be and especially those containing at least about 95 wt. % base metal and up to 5 wt.

% Be, and even up to about 3 wt. % Be. Especially preferred are copper alloys containing about 0.3 to 3.3 wt. % Be, nickel alloys containing about 0.4 to 4.3 wt. % Be and aluminum alloys containing about 1 to 75 wt. % Be. The addition of as little as 0.05 wt. % Be to these base metals produces dramatic enhancements in a number of properties including strength, oxidation resistance, castability, workability, electrical conductivity and thermal conductivity making them ideally suited for use in the present invention. Be additions on the order of at least 0.1 wt. %, more typically 0.2 wt. % are more typical.

These alloys may contain additional elements such as Co, Si, Sn, W, Zn, Zr, Ti, Al, Nb, Mn, Mg, Mo, C, Cr, Fe, Y, RE's and others usually in amounts not exceeding 10 wt. %, preferably not exceeding 2 wt. %, or even 1 wt. %, per element. In addition, each of these base metal alloys can contain another of these base metals as an additional ingredient. For example, the Cu—Be alloy can contain Ni, Co, Zr and/or Al as an additional ingredient, again in an amount usually not exceeding 30 wt. %, more typically no more than 15 wt. %. Usually such alloys will have no more than 2 wt. %, and even more typically no more than 1 wt. % of this additional element.

These alloys are described, generally, in Harkness et al., Beryllium-Copper and Other Beryllium-Containing Alloys, *Metals Handbook,* Vol. 2, 10th Edition, ©1993 ASM International, the disclosure of which is incorporated by reference herein.

A preferred class of this type of alloy is the C81000 series and the C82000 series of high copper alloys as designated by the Copper Development Association, Inc. of New York, N.Y.

Another preferred class of these alloys are the lean, high conductivity, stress-relaxation resistant BeNiCu alloys described in U.S. Pat. No. 6,001,196, the disclosure of which is also incorporated herein by reference. These later alloys contain 0.15 to 0.5 wt. % Be, 0.4 to 1.25 wt. % Ni and/or Co, 0 to 0.25 wt. % Sn and 0.06 to 1.0 wt. % Zr and/or Ti. Another preferred class of alloys can be described as containing more than 1.5 wt. % Be, with the balance being composed mainly of copper and other elements.

The excellent physical properties of the above alloys arise through a precipitation-hardening mechanism in which fine beryllide precipitates form in the base metal matrix. So long as beryllium is present in an appropriate amount, a small but suitable portion of this beryllium forms base metal beryllide precipitates of small particle size during precipitation hardening. These small precipitate particles uniformly distribute in the base matrix, thereby enhancing its strength. If too much beryllium is present, exceeding the solid solubility limit of beryllium in the base metal, the excess beryllium forms primary nickel beryllide particles, 1 $\mu$m in diameter or larger, during solidification. These serve no useful purpose in increasing the strength of the alloys, and may have a detrimental effect on the fracture resistance of the alloys, since they become preferred sites for nucleation of voids. Therefore, the amount of beryllium in the alloy should not be so much that the alloy becomes too brittle or weak, as a practical matter, from formation of large primary base metal-beryllium intermetallic particles.

Forming useful products from ingots of the above precipitation hardenable alloys typically involves a series of heating and working steps to impart the desired shape, grain structure and properties to the alloy. These steps in the aggregate can be considered as constituting (a) a shaping regimen for changing the bulk shape of the alloy as derived from the ingot into a shape approaching the final desired shape of the product (a "near net shape") and also for imparting a finer, more nearly uniform grain structure to the alloy, and (b) a precipitation hardening regimen for nucleating and growing the fine nickel beryllide precipitates responsible for hardening.

Commercially, the shaping regimen involves one or more working steps and solution heat treatment steps (homogenization and/or annealing). Homogenization and annealing are typically done by heating the alloy near but below its solidus temperature to dissolve alloy solute elements in the alloy matrix, thereby achieving a more nearly uniform distribution of ingredients.

Working can be done either at elevated temperatures ("hot working") or at lower temperatures such as room temperature ("cold working"). Both working and annealing may be done multiple times, especially if change in shape is large, with a final solution anneal usually being done last.

Precipitation hardening is accomplished by heating the alloy at a fairly narrow temperature range roughly midway between the solvus temperature and room temperature for 0.5 to 20 hours. Precipitation hardening temperatures approaching the solvus temperature are usually avoided, since it is difficult to control the results obtained at these higher temperatures and the nature of the precipitates changes significantly. Precipitation hardening at less than a minimum practical hardening temperature at which precipitation hardening is too slow to be commercially feasible is also avoided. In general, each precipitation hardenable alloy has its own particular time/temperature combination leading to maximum hardness, meaning that if the alloy is heated either too little or too much its hardness and other properties are less than optimal, Thus, it is conventional to refer to such alloys as being "peak aged" if age hardened at or near optimal time/temperature conditions, or as underaged or overaged if heated too little or too much.

Additional Alloys

Another type of alloy that can be used in making the inventive shot block is the alloy known as "Anviloy," which is a tungsten-based alloy containing at least about 80 wt. % tungsten, at least about 1 wt. % molybdenum and one or more additional elements such as iron and nickel.

A different but related alloy that can also be used in the present invention, designated as "TZM," is a molybdenum based alloy containing at least about 80 wt. % molybdenum, and small amounts of titanium, zirconium or both. Specific examples of such alloys are as follows:

TABLE 1

Additional High Conductivity Die Materials

| Die Material Composition (wt. %) | Rockwell C Hardness | Thermal conductivity Btu/ft. hr. F | Charpy V-notch Impact Strength ft-lb |
|---|---|---|---|
| Anviloy 90 W, 4 Mo, 2 Fe, 4 Ni | 34 | 74 | 2.0 |
| TZM 99.4 Mo, 0.5 Ti, 0.1 Zr | 25 | 81 | Less than 2.0 |

Spinodal Alloys

Another class of alloys that is especially useful in making the inventive shot blocks is the spinodal alloys—i.e., alloys which spinodally decompose upon age hardening. A particularly interesting group of alloys of this type is the Cu—Ni—Sn spinodal alloys. These alloys, the most commercially important of which contain about 8 to 16 wt. % Ni and 5 to 8 wt. % Sn with the balance being Cu and incidental impurities, spinodally decompose upon final age hardening to provide alloys which are both strong and ductile as well as exhibiting good electrical conductivity, corrosion resistance in $Cl^-$, wear resistance and cavitation erosion resistant. In addition, they are machinable, grindable, platable and exhibit good non-sparking and anti-galling characteristics. These alloys are described in U.S. Application Ser. 08/552,582, filed Nov. 3, 1995 (corresponds to New Zealand Patent No. 309290), the disclosure of which is also incorporated by reference. Especially preferred alloys of this type include those whose nominal compositions are 15Ni-8Sn—Cu (15 wt. % Ni, 8 wt. % Sn, balance Cu) and 9Ni-6Sn—Cu, which are commonly known as Alloys UNS C72700, C72900, C96800 and C96900 under the Unified Numbering System of the Copper Development Association. In addition to Ni and Sn, these alloys may also contain additional elements for enhancing various properties in accordance with known technology as well as incidental impurities. Examples of additional elements are B, Zr, Mn, Nb, Mg, Si, Ti and Fe.

In a particularly advantageous application of the present invention, the inventive shot blocks are made Ni—Sn—Cu spinodal alloys described in the above-noted U.S. Application Ser. No. 08/552,582 (New Zealand Patent No. 309,290) by the continuous casting technology also described in that application. In this technology, molten alloy is introduced into a continuous casting die in such a manner that turbulence is created at the liquid/solid interface. Because of this "turbocasting" procedure, a finer, more nearly uniform grain structure is achieved than possible before. As a result, the castings so obtained can be directly precipitation hardened without wrought processing first, as normally done when products formed from conventional precipitation hardenable alloys are made. Because wrought processing has been eliminated, products can be made in bigger sizes and/or more complex shapes than possible before. This can represent a significant advantage in making the inventive shot blocks, which may be large in size or complex in shape depending on the particular application in which they will be used.

In an especially preferred embodiment of this invention, shot blocks made in this manner are subjected to the hot isostatic pressing technology described in the above-noted Ser. No. 09/797,465 (20721/04425). In this technology, turbocast ingots made from the above Ni—Sn—Cu spinodal alloys are subjected to hot isostatic pressing preferably before spinodal decomposition. This enables even better properties to be achieved in final products with bigger sizes and/or more complex shapes.

Powder Metallurgy

In addition, to making the inventive shot blocks by casting techniques, as described above, the inventive shot blocks can also be made by powder metallurgy techniques as well. In these techniques, a "green compact" having a shape approximating the shape of the final desired product is made by compacting a mass of alloy powder under high pressure. The compact is then heated, during or after compaction, to cause contiguous particles to fuse to one another, thereby producing a final product of the desired shape and chemical composition. Depending on how the process is carried out, products having densities up to 100% of theoretical can be produced.

This preparation method can also be used to advantage in making the inventive shot blocks, especially those having large and/or complex shapes.

WORKING EXAMPLES

In order to demonstrate the advantages of the present invention, shot blocks made in accordance with the invention were directly compared with a conventional shot block in terms of their impact on die casting cycle time.

Example 1 and Comparative Example A

In each of these examples, a conventional die casting machine of the type described above was used to repeatedly squeeze cast aluminum plates from an aluminum casting alloy (A356) composed of 7 wt. % Si, 0.3 wt. % Mg, with the balance being Al and incidental impurities. In these examples, the machine was equipped with a shot block mounted on the cover side of the casting die such that it received the end of a shot sleeve (pressure cylinder), provided for receiving an associated plunger. The temperature of the metal biscuit in the shot block was measured by a thermocouple.

In Example 1 representing the present invention, the shot block was made from a precipitation hardened copper alloy composed of 0.4 wt. % Be, 1.80 wt. % Ni, with the balance being Cu and incidental impurities. The thermal conductivity of this alloy was 145 Btu/ft.hr.° F., In Comparative Example A representing conventional technology, shot block 50 was made from H13 tool steel die, whose thermal conductivity was 15 Btu/ft.hr.° F.

In both examples, the die casting machine was operated in the same way, with the same amount of coolant being supplied to the shot block for cooling the metal biscuit. The temperature of the metal biscuit was continuously monitored, and the time determined when this temperature had dropped to 950° F. This temperature was taken to be low enough so as to not present an explosion hazard, and so the die was opened at this time, thereby signaling the end of the casting cycle.

It took 18.2 seconds for the temperature of metal biscuit 58 to drop to 950° F. when the shot block of Example 1 was used but 28.6 seconds when the shot block of Comparative Example A was used. This means that the inventive shot block of Example 1 enabled a 36% reduction in cycle time [(28.6−18.2)/28.6] relative to the conventional shot block of Comparative Example A. This, in turn, translates to a 36% increase in the efficiency when the die casting machine used in these examples was equipped with the inventive shot block, which is a tremendous economic advantage.

Examples 2, 3 and 4

Example 1 was repeated except that shot block 50 was made from different alloys in accordance with the present invention. The identity of these alloys and the results obtained are set forth in the following Table 2.

TABLE 2

| Cycle Times | | | |
|---|---|---|---|
| Ex | Alloy | Therm. Cond. Btu/ft. hr. ° F. | Cycle Time, seconds |
| A | H13 | 15 | 28.6 |
| 1 | Cu0.40Be1.80Ni | 145 | 18.2 |
| 2 | 90 W, 4 Mo, 2 Fe, 4 Ni | 74 | 23.5 |
| 3 | Cu9Ni6Sn | 37 | 20.0 |
| 4 | Cu1.90Be0.25Cu | 60 | 18.0 |

As can be seen from this table, the shot blocks of Examples 2, 3 and 4 also provided a significant improvement in cycle time relative to the shot block made according to conventional technology.

Although only a few embodiments of the present invention have been described above, it should be appreciated that many modifications can be made without departing from the spirit and scope of the invention. All such modifications are intended to be included within the scope of the present invention, which is to be limited only by the following claims:

We claim:

1. A shot block for use in a die casting machine, the shot block defining a reservoir for receiving molten or semi-molten metal under pressure, the shot block further being shaped to receive the plunger of the die casting machine and further defining at least one passageway for receipt of a cooling fluid flowing through the shot block, wherein the shot block is formed from alloy having a thermal conductivity of at least 25 Btu/ft.hr.F., a Rockwell C hardness of at least 25 and a 0.2% Yield Strength of at least 90 ksi, wherein the alloy is either (a) a precipitation hardenable alloy consisting essentially of a copper, nickel or aluminum base metal and about 0.05 to 75 wt. % Be, or (b) a spinodal alloy consisting essentially of Cu—Ni—Sn.

2. The shot block of claim 1, wherein the alloy is composed of a precipitation hardenable alloy consisting essentially of a copper, nickel or aluminum base metal and about 0.05 to 75 wt. % Be.

3. The shot block of claim 2, wherein the alloy is composed of at least about 90 wt. % base metal and up to about 10 wt % Be.

4. The shot block of claim 3, wherein the alloy is a copper alloy containing about 0.3 to 3.3 wt. % Be, a nickel alloy containing about 0.4 to 4.3 wt. % Be or an aluminum alloy containing about 1 to 75 wt. % Be.

5. The shot block of claim 2, wherein the alloy contains at least one additional element selected from the group consisting of Co, Si, Sn, W, Zn, Zr, Ti, Al, Nb Mn, Mg, Mo, C, Cr, Fe, Y and a rare earth element in an amount not exceeding 10 wt. %.

6. The shot block of claim 1, wherein the shot block is formed from a Cu—Ni—Sn spinodal alloy.

7. The shot block of claim 6, wherein the shot block is made by turbocasting an alloy containing about 8 to 16 wt. % Ni and 5 to 8 wt. % Sn, up to about 2.0 wt. % additives, with the balance being Cu and incidental impurities.

8. The shot block of claim 7, wherein the additives are selected from the group consisting of B, Zr, Mn, Nb, Mg, Si, Ti and Fe.

9. The shot block of claim 7, wherein the shot block is subjected to hot isostatic pressing prior to spinodal decomposition.

10. In a die casting machine including a die and optional die insert defining a die cavity, a pressure cylinder for supplying molten or semi-molten metal to the die under pressure and a shot block mounted on one or more steel parts, the shot block defining a reservoir for transferring the molten or semi-molten metal received from the pressure cylinder to the die, the improvement wherein the shot block is made form from an alloy having a thermal conductivity of at least 25 Btu/ft.hr.F., a Rockwell C hardness of at least 25 and a 0.2% Yield Strength of at least 90 ksi, and further wherein the alloy is either:

(a) a precipitation hardenable alloy consisting essentially of a copper, nickel or aluminum base metal and about 0.05 to 75 wt. % Be, or (b) a spinodal alloy consisting essentially of Cu—Ni—Sn.

11. The die casting machine of claim 10, wherein the die and optional die insert defining the die cavity of the die casting machine are each independently made from H11 or H13 tool steel.

12. The die casting machine of claim 11, wherein the alloy is composed of a precipitation hardenable alloy consisting essentially of a copper, nickel or aluminum base metal and about 0.05 to 75 wt. % Be.

13. The die casting machine of claim 12, wherein the alloy is composed of at least about 90 wt. % base metal and up to about 10 wt % Be.

14. The die casting machine of claim 13, wherein the alloy is a copper alloy containing about 0.3 to 3.3 wt. % Be, a nickel alloy containing about 0.4 to 4.3 wt. % Be or an aluminum alloy containing about 1 to 75 wt. % Be.

15. The die casting machine of claim 12, wherein the alloy contains at least one additional element selected from the group consisting of Co, Si, Sn, W, Zn, Zr, Ti, Al, Nb Mn, Mg, Mo, C, Cr, Fe, Y and a rare earth element in an amount not exceeding 10 wt. %.

16. The die casting machine of claim 11, wherein the shot block is formed from a Cu—Ni—Sn spinodal alloy.

17. The die casting machine of claim 16, wherein the shot block is made by turbocasting an alloy containing about 8 to 16 wt. % Ni and 5 to 8 wt. % Sn, up to about 2.0 wt. % additives, with the balance being Cu and incidental impurities.

18. The die casting machine of claim 17, wherein the additives are selected from the group consisting of B, Zr, Mn, Nb, Mg, Si, Ti and Fe.

19. The die casting machine of claim 17, wherein the shot block is subjected to hot isostatic pressing prior to spinodal decomposition.

* * * * *